US006801792B1

(12) United States Patent
Schuster et al.

(10) Patent No.: US 6,801,792 B1
(45) Date of Patent: Oct. 5, 2004

(54) METHOD FOR COMMUNICATION WITH A TRANSPORTATION SYSTEM

(75) Inventors: Kilian Schuster, Ballwil (CH); Paul Friedli, Remetschwil (CH)

(73) Assignee: Iventio AG, Hergiswil NW (CH)

( * ) Notice: Subject to any disclaimer, the term of this patent is extended or adjusted under 35 U.S.C. 154(b) by 0 days.

(21) Appl. No.: 09/545,843

(22) Filed: Apr. 10, 2000

(30) Foreign Application Priority Data

Apr. 9, 1999 (EP) ..... 99810293

(51) Int. Cl.[7] ..... B66B 3/00

(52) U.S. Cl. ..... 455/566; 340/5.31; 340/5.21; 187/393; 187/391; 187/396

(58) Field of Search ..... 455/566; 187/394, 187/392, 391, 396; 340/5.1, 3.1, 540

(56) References Cited

U.S. PATENT DOCUMENTS 5,689,094 A * 11/1997 Friedli et al. ..... 187/384

6,062,346 A * 5/2000 Friedli et al. ..... 187/395

FOREIGN PATENT DOCUMENTS

GB 2241090 * 8/1991 ..... B66B/1/20

* cited by examiner

*Primary Examiner*—Nay Maung
*Assistant Examiner*—Alan Gantt
(74) *Attorney, Agent, or Firm*—MacMillan, Sobanski & Todd, LLC

(57) ABSTRACT

A method for communication with a transportation system utilizes a human-machine interface with a control unit that constantly checks for the presence of contactlessly communicating information carriers. If a user with an information carrier is located in the reception range, the control unit requires the information carrier to transfer at least identification data of the user to the control unit. The control unit then displays an individualized communication surface matched to the respective user on the basis of the received data.

10 Claims, 1 Drawing Sheet

METHOD FOR COMMUNICATION WITH A TRANSPORTATION SYSTEM

BACKGROUND OF THE INVENTION

The present invention relates to a method for communication with a transportation system in which at least one man/machine interface is provided for the input of travel destinations and for user information.

The European patent specification EP 0 699 618 A1 shows equipment that enables an implicit input of destination calls in elevator installations. An information transmitter transmits data after a corresponding request by a recognition device. The data can contain direct items of information about the desired destination floor or serve for the identification of the elevator user. The destination floor is evaluated in a processing unit on the basis of the received data and identified to an elevator control. The allocation of the destination floor to the elevator car with the best possible travel conditions is made known to the user on a display.

A disadvantage of this known equipment is that the information content of the information transmitter and the display is relatively limited and offers no possibility of immediate adaptation.

SUMMARY OF THE INVENTION

The present invention meets the objective of avoiding the disadvantages of the known equipment and of proposing a method that individually matches the possibilities for use of a transport system to each user.

The advantage achieved by the present invention is that human-machine communication can be matched to the needs of each user. The communication is tailored to the user to facilitate access for the user to the transportation system. The user can more easily orient himself on the basis of the individual, personal communication. Moreover, the user can be supplied with individual information concerning use of the system and also with other information.

The present invention concerns a method for user communication with a transportation system comprising the steps of: providing an information carrier having individual information associated with a user of a transportation system; providing a human-machine interface for receiving the individual information from the information carrier; selecting symbols to be displayed to the user from stored information representing actual location parameters of a plurality of travel destinations served by the transportation system and a plurality of symbols associated with the location parameters, the selection of the symbols being based upon the individual information provided; and displaying to the user the selected symbols on a communication surface for inputting a desired one of the travel destinations associated with the selected symbols. The human-machine interface automatically checks for the presence of the information carrier and requires the information carrier to transfer to the human-machine interface at least identification data associated with the user as the individual information.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
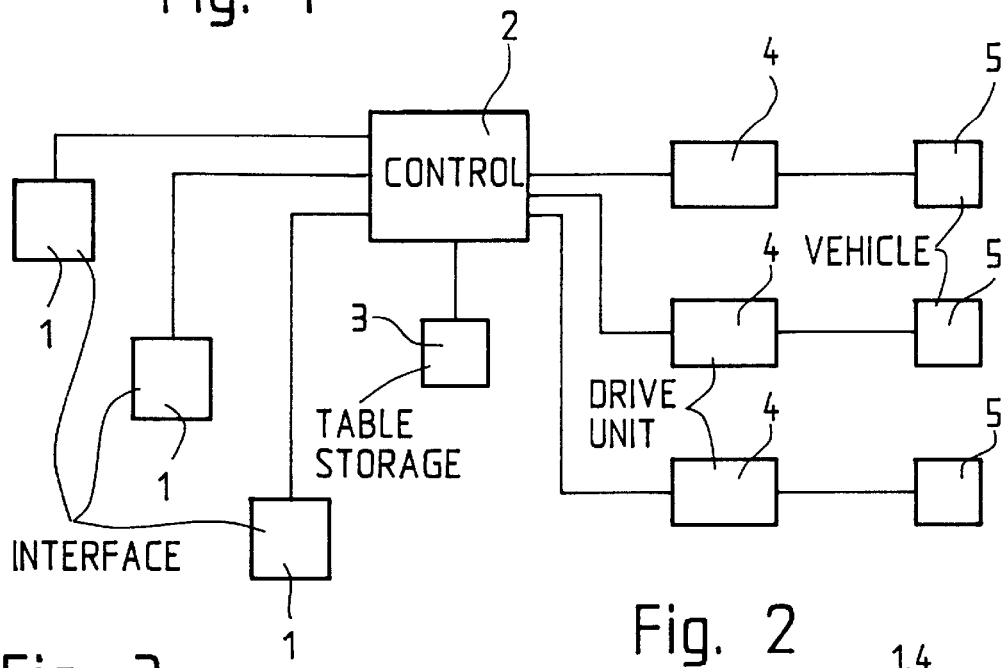
FIG. 1 is a schematic block diagram of a transportation system having several vehicles and operating in accordance with the present invention.

In the FIGS. 1 to 4, there is shown a human-machine interface 1 by means of which a user communicates his travel destination to a control of a transportation system. FIG. 1 shows a transportation system having a control 2, consisting in essence of a processor and memory, that has access to a source of information in the form of, for example, a connected table storage device or means 3 containing the real locational parameters of the available travel destinations and the designations assigned to the locational parameters. Also connected to the control 2, either by wire or wireless, are several of the human-machine interfaces 1. The transportation system can, for example, be an elevator system with at least one elevator hoistway, in which several vehicles 5, specifically elevator cars, travel with a high degree of autonomy, and the direction of movement can be vertical and/or horizontal. In the simplest case, the transportation system comprises an elevator with one or more elevator cars 5, each elevator hoistway having one elevator car traveling in it. Connected to the control 2 are drive units 4 to control and supply associated ones of the vehicles 5, specifically the elevator cars.

Figure 2:
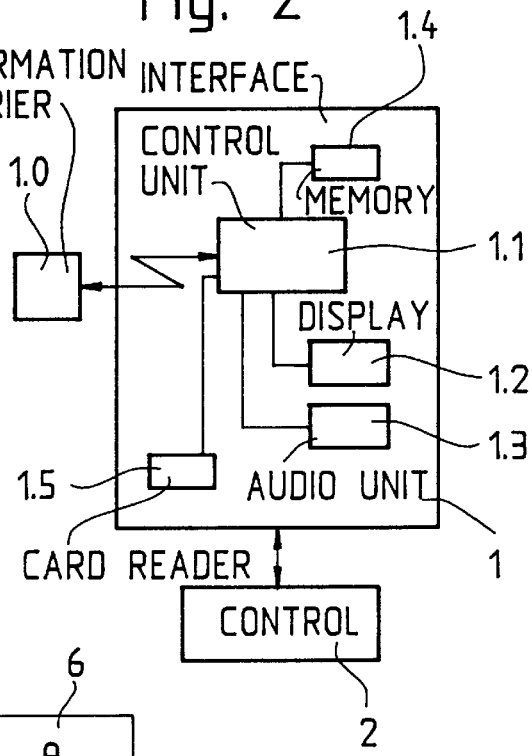
FIG. 2 is a block schematic diagram of one of the human-machine interfaces shown in the FIG. 1.

The FIG. 2 shows one of the human-machine interfaces 1 as including a control unit 1.1 with computer and working memory. Connected to the control unit 1.1 are a visual display such as a touch screen 1.2, an audio unit 1.3, a memory 1.4 and, optionally, a card reader 1.5. An information carrier 1.0, which can come into connection with the control unit 1.1, is provided per user. The information carrier 1.0 can contactlessly communicate with the control unit 1.1 or, in the case of the card reader 1.5, can be an information card that transfers data of the user to or from the control unit 1.1. A keyboard with, for example, touch buttons and a display screen can also be provided instead of the touch screen 1.2. The control unit 1.1 constantly checks for the presence of contactlessly communicating information carriers 1.0. If a user with an information carrier 1.0 is located in the reception range, the control unit 1.1 requires the information carrier 1.0 to transfer at least identification data of the user to the control unit 1.1. An individual communication surface is generated on the touch screen 1.2 on the basis of the data.

The information carrier 1.0 can also contain information about the objects brought along with the user, such as for example shopping trolleys, beds, etc. The serving of the user is then carried out on the basis of the additional information.

A biometric method can also be used for identification of the user, wherein the user is unambiguously identified on the basis of, for example, fingerprint, handprint, facial outlines, retinal or iris structure, or speech.

Figure 3:
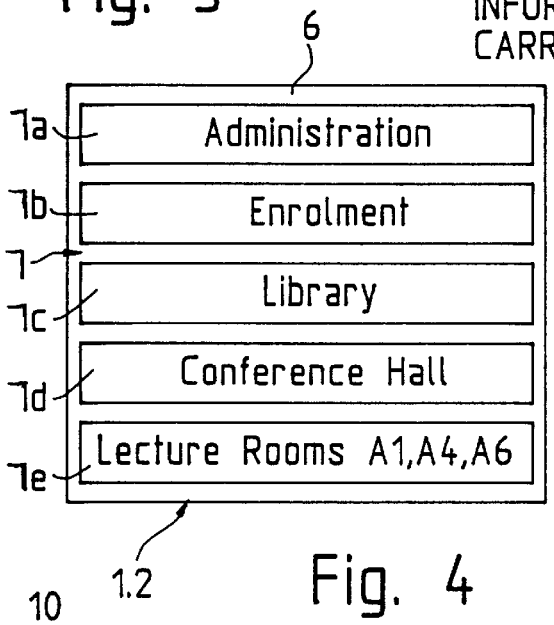
FIG. 3 shows a designation display screen of one of the human-machine interfaces of the FIG. 1.

FIG. 3 shows the touch screen 1.2 with a communication display surface 6 individualized for, for example, a teacher of a high school. Actual location particulars such as, for example, numerical floor details, are replaced by symbols in the form of a plurality of soft keys 7 including soft keys 7*a* through 7*e*. The teacher is authorized for access to the shown premises. If the user is a student or person from outside, access can be restricted in simple manner to specific floors or travel destinations. Then merely "lecture rooms" on soft key 7*e*, "library" on soft key 7*c* and "enrollment" on soft key 7*b* appear on the communication surface 6 of the touch screen 1.2.

In the case of use of the human-machine interface 1 according to the invention in a hospital, the communication surface 6 can, for example, be made available for legitimate users such as, for example, doctors or nursing staff. In the case of, for example, bed transport a communication surface can be made available which enables a statement of the requirement for space or special trips for emergency cases.

In the case of use of the human-machine interface 1 in a hotel, the communication surface 6 can, for example, be made available by means of which the hotel guest is provided with further information such as, for example, activities for VIP guests, the menu or that the guest concerned is expected in the bar. Information such as, for example, advertising, communications to other users, information for assistance of users, references to other transportation, etc., can be communicated to the user by means of the touch screen 1.2. The user can also deposit information for other users by means of the touch screen 1.2.

The communication surface 6 can be made available to authorized persons such as, for example, maintenance personnel and assists the informatory or diagnostic functions or the maintenance or the easing of the transport system.

The communication surface 6 can be designed in different manner according to the respective user. Instead of the illustrated soft key bars 7*a* through 7*e* according to FIG. 3, there can be represented, for example, a synopsis of the transport system on which the travel destinations are selectable and/or on which the instantaneous positions of the vehicles are shown. The identification data of the user also contains details of, for example, handicaps of the user. The communication surface 6 is supplemented for a visually handicapped user by switching on of the audio unit 1.3, wherein the control unit 1.1 verbally communicates with the user or the user with the control unit 1.1. The audio unit 1.3 can also be used for background music according to the preference of the respective user.

On the basis of the selected travel destination, the control 2 allocates the transport request to the vehicle with the best travel conditions. The user is informed about his vehicle, such as, for example, shown in FIG. 4, by the touch screen 1.2 and/or by the audio unit 1.3.

The data necessary for generation of the individual communication surface 6 can be filed in the memory 1.4 to which the control unit 1.1 has access. If this data is present on the information carrier 1.0, an explicit identification of the user is not necessary. In a further variant, this data can be present partly on the information carrier 1.0 and partly in the memory 1.4. The control unit 1.1 can also transfer information to the information carrier 1.0. Existing data, for example the balance of a bank account, can thus also be changed or modified. If appropriate input units are available, the user himself can at least partially configure the information of the information carrier 1.0.

The information obtained by the use of the transport system can also be used for other purposes. For example, a search system for persons can localize the instantaneous user of the transport system, or the habits, which are established by the use of the transport system, of the user can be used for advertising purposes.

The authorized travel destinations of a teacher of a high school are shown on the touch screen 1.2 of FIG. 3 and are individually selectable by contacting the screen 1.2. Further information can be called up by means of window technique or scroll technique. The travel destinations are represented not as actual location particulars, such as for example a story number, but by means of symbols which describe the travel destination, for example, functionally. The user selects, for example, the conference hall (soft key 7*d*) as his travel destination without knowing where the conference hall is actually located. After the selection of the travel destination, the control unit 1.1 can call for further information from the user, for example the attendee number.

Figure 4:
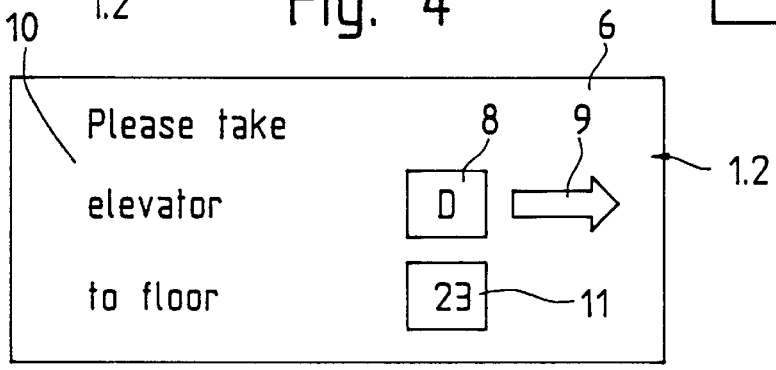
FIG. 4 shows an information display screen of one the human-machine interfaces of the FIG. 1.

The control 2 ascertains the actual location particulars of the selected destination by means of the information stored in the table 3, in which, for example, the actual location statement "story 23" is assigned to the symbol "conference hall". The control 2 allocates the desired floor to the elevator car with the best travel conditions and informs the user, as shown in FIG. 4, on the touch screen 1. The information comprises the designation of the vehicle, in the present case elevator car "D" displayed in a vehicle identification area 8, and a reference to the boarding location, in the present case a directional arrow to the right in a direction arrow area 9. The information further comprises, in the case of multi-door elevator cars, the door side or, in the case of transport systems with horizontal and/or vertical transport, the coordinates of the boarding location. The user can receive boarding instructions in an information instruction area 10 and the destination floor number "23" can be displayed in a travel destination identification area 11.

During travel, the travel destinations where stops are made are indicated, wherein the actual location particulars and/or the symbols are used.

The table 3 can be changed over time according to the respective utilization of the building. If, for example, a room is used as a conference ball during the day and as a ballroom at night, the corresponding symbol is adapted to the use of the room.

Other easily remembered symbols standing in relationship to the travel destination, such as for example names, telephone numbers, pet names for kindergartens, etc., are also possible.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for user communication with a transportation system comprising the steps of:

a. providing a human-machine interface for receiving individual information associated with a user of a transportation system and having an interactive communication surface;

b. selecting symbols to be displayed to the user from stored information representing actual location parameters of a plurality of travel destinations served by the transportation system and a plurality of symbols associated with and functionally describing the location parameters, the selection of the symbols being based upon the individual information provided and representing only ones of the travel destinations for which the user is authorized; and c. displaying to the user the selected symbols on the communication surface for inputting a desired one of the travel destinations associated with the selected symbols.

2. The method according to claim 1 wherein said individual information includes user-specific data.

3. The method according to claim 2 wherein said user-specific data includes at least one of fingerprint, handprint facial outlines, retinal or iris structure, and speech.

4. The method according to claim 1 wherein said individual information includes data representing objects brought along with the user.

5. The method according to claim 1 including automatically checking for the presence of an information carrier having the individual information and requiring the information carrier to transfer to the human-machine interface at least identification data associated with the user as the individual information.

6. The method according to claim 1 wherein the communication surface is at least one of a visual display and an audio unit.

7. The method according to claim 1 wherein the communication surface displays at least one of vehicle identification, direction arrow, information instruction and travel destination identification to the user.

8. The method according to claim 1 wherein the selected symbols displayed on the communication surface are common names for the associated travel destinations.

9. A method for user communication with a transportation system comprising the steps of:

a. providing an information carrier having individual information associated with a user of a transportation system;

b. providing a human-machine interface for receiving the individual information from the information carrier;

c. selecting symbols to be displayed to the user from stored information representing actual location parameters of a plurality of travel destinations served by the transportation system and a plurality of symbols associated with and functionally describing the location parameters, the selection of the symbols being based upon the individual information provided and representing only ones of the travel destinations for which the user is authorized; and d. displaying to the user the selected symbols on a communication surface of the interface for inputting a desired one of the travel destinations associated with the selected symbols.

10. The method according to claim 9 including automatically checking for the presence of the information carrier and requiring the information carrier to transfer to the human-machine interface at least identification data associated with the user as the individual information.

* * * * *